US005336052A

United States Patent [19]

Zöllner et al.

[11] Patent Number: 5,336,052

[45] Date of Patent: Aug. 9, 1994

[54] VISCOUS MATERIAL PUMP

[75] Inventors: Jörg-Peter Zöllner, Glinde; Winfried Bussmann, Geesthacht, both of Fed. Rep. of Germany

[73] Assignee: Abel Pumpen GmbH & Co. KG, Buchen, Fed. Rep. of Germany

[21] Appl. No.: 54,409

[22] Filed: Apr. 28, 1993

[51] Int. Cl.[5] ..... F04B 35/02

[52] U.S. Cl. ..... 417/20; 417/44 A; 417/205; 417/900

[58] Field of Search ..... 417/900, 20, 44 R, 44 A, 417/205

[56] References Cited

U.S. PATENT DOCUMENTS

| | | | |
|---|---|---|---|
| 3,234,882 | 2/1966 | Douglas et al. | 417/342 X |
| 4,531,892 | 7/1985 | Näsman | 417/205 |
| 4,575,313 | 3/1986 | Rao et al. | 417/44 A |
| 5,106,272 | 4/1992 | Oakley et al. | 417/900 X |
| 5,174,732 | 12/1992 | Hoya | 417/900 X |
| 5,222,872 | 6/1993 | Marian et al. | 417/900 X |

*Primary Examiner*—Richard E. Gluck
*Attorney, Agent, or Firm*—Emrich & Dithmar

[57] ABSTRACT

The present invention relates to a viscous material pump. According to the invention, a pressure sensor is associated with the hydraulic drive cylinder of the fixed displacement pump for generating a pressure signal when a first sudden pressure increase occurs after the drive piston moves out of its end position. The volume subsequently displaced by the conveying piston corresponds to the actual delivery volume during the pumping stroke. A processor calculates the actual delivery volume for each pumping stroke using the ratio between the stroke time, as defined by the occurrence of the pressure peak and the maximum available conveying volume of the cylinder, as defined by the stroke time the piston needs to move from its first to its second end position. The present invention further provides for adjusting the supply volume of a supply means discharging the material to the viscous material pump. To this purpose the pumping stroke time of the conveying cylinder up to the pressure increase in the drive cylinder is compared with a predetermined time for generating a signal to increase the supply volume when the measured stroke time exceeds a predetermined time.

5 Claims, 1 Drawing Sheet

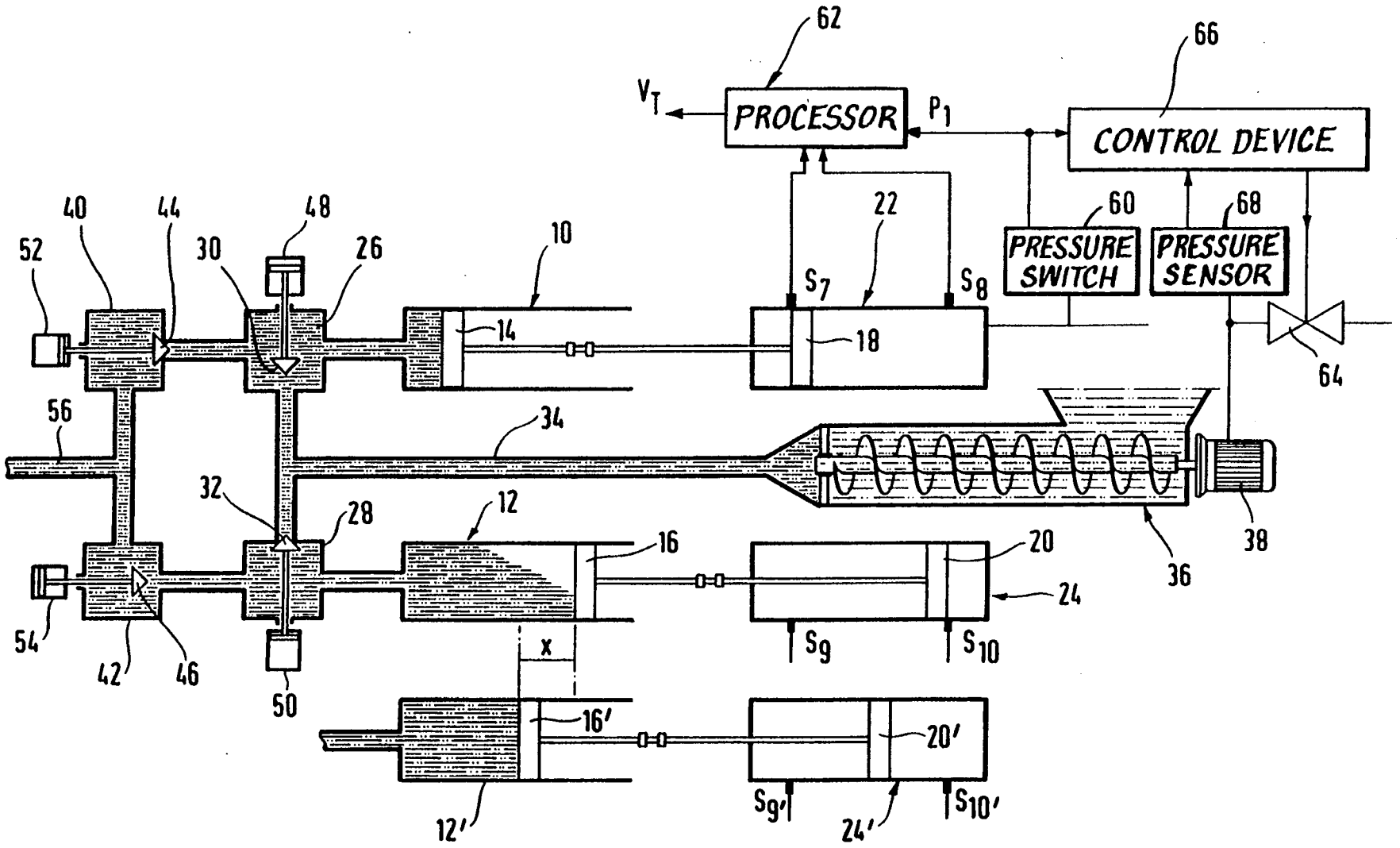
CONTROL DEVICE
PRESSURE SENSOR
PRESSURE SWITCH
PROCESSOR
$P_1$
$V_T$
$S_7$
$S_8$
$S_9$
$S_{9'}$
$S_{10}$
$S_{10'}$
x
10
12
12'
14
16
16'
18
20
20'
22
24
24'
26
28
30
32
34
36
38
40
42
44
46
48
50
52
54
56
60
62
64
66
68

VISCOUS MATERIAL PUMP

BACKGROUND OF THE INVENTION

The present invention relates to a viscous material pump for pumping slurry materials and the like and, more particularly, to means and to a method for precisely measuring the delivery volume of the viscous material pump.

Viscous material pumps for conveying and rating pasty materials, for example slurries or the like, are known in various embodiments. It is further known to use self-priming positive displacement piston pumps. The conveying piston of at least a conveying cylinder is connected to the drive piston of a hydraulic drive cylinder, wherein the end positions of the drive piston are sensed by end position transmitters or by means of directional valves to generate control signals for a valve operable to selectively connect the conveying cylinder to a supply or delivery line. The supply line regularly includes a supply means, for example a screw pump, to deliver the material towards the conveying cylinder.

The efficiency of a pump of this type not only depends on the theoretical delivery volume of the conveying cylinder and its cycle time, but further depends on the percent fill possibly being reached during each suction stroke. It is known to measure the delivery volume of this type of pump using a method based on inductivity. However, this type of measurement relies on a minimum flow rate and a minimum volume of liquid in the material. For example, U.S. Pat. No. 5,106,272 discloses a measuring system indicating during each pumping stroke when the material begins to flow. The actual delivery or pumping stroke time is shorter than the time needed for the overall pumping stroke of the conveying piston such that the ratio between both theses values indicates the percent fill of the conveying cylinder during the preceding filling stroke. Summing up the individual filling volumes with respect to time results in an indication of the actual delivery volume. The known method suffers from the drawback that a valve determines or controls when the material begins to flow, which valve prematurely opens when a low or zero counter pressure prevails in the delivery line, thus not permitting the obtaining of accurate measuring values of the viscous material pump.

In other known systems, the viscous material pump and the supply means operate independently from each other. It is known to match the delivery volumes with respect to each other by undertaking a visual control. An adjustment of the supply means is performed by locally adjusting a mechanical throttle valve, for example, or by a remote control by means of a potentiometer and proportional valve. However, this system is not suited to obtain a maximum efficiency of the viscous material pump.

SUMMARY OF THE INVENTION

It is an object of the present invention to provide a viscous material pump for performing a simple measurement of the delivery volume, and in particular, for controlling the pump performance.

According to the present invention the object referred to is solved by the features of the appended claims.

According to the present invention, a pressure sensor is associated with the hydraulic drive cylinder to generate a pressure signal indicating a first jump like pressure increase after the drive piston has moved out of its end position. This is based upon the recognition that the pressure increase occurs in the very moment where a bulk of material to he pumped has built up in the conveying cylinder. Accordingly, the volume displaced by the conveying piston from this very moment corresponds to the actual delivery volume during the pumping stroke. A processor determines the delivery volumes by calculating the actual delivery volume during each pumping stroke from the ratio between the stroke times and the maximum available delivery volume. The means necessary for performing the method according to the invention are extremely little. Like with conventional viscous material pumps of the type referred to above, the end positions of the drive piston in the drive cylinder are sensed in a conventional manner. Accordingly, it is merely necessary to provide a pressure sensing means for the drive cylinder, for example, a pressure switch to indicate the pressure increase. During the pumping stroke, a plurality of pressure peaks may of course occur, however, merely the first pressure peak is used to measure the delivery volume or, respectively, the percent fill. A first and a second time measuring means determines the stroke time of the piston moving between the end positions as well as the time between the one end position when the pumping stroke begins and when the pressure peak occurs. Disregarding the simple provisions, the measurement of the delivery volume is extremely accurate.

Furthermore, the present invention provides a means to simply match the volume rate of the supply means to that of the viscous material pump. As mentioned above, the stroke time between the one end position and the pressure peak is an indication for the filling rate. According to an embodiment of the invention, the drive means and/or the supply means are adjustable to change the supply volume delivered to the conveying cylinder. Further, a comparing means is provided for comparing the pumping stroke time up to the pressure increase in the drive cylinder with a predetermined time period to supply a signal to the drive means and/or the supply means for increasing the delivery volume when the stroke time measured exceeds the predetermined time. There is no doubt that a filling rate of 100% is ideal. However, this is relatively difficult to obtain under practical conditions. It is thus tolerated that there is a minimum dead stroke time during the pumping stroke in order to obtain a stable control.

In the operation of the viscous material pump according to the present invention, it is possible that the volume delivered by the supply means is higher than the delivery volume of the viscous material pump. To provide a synchronism between both pumping means, a further embodiment of the present invention provides a hydraulic or electrical drive means to be controlled, wherein a measuring means measures the pressure or, respectively, the current to generate a signal for decreasing the delivery volume when the pressure and/or the current exceeds a predetermined value. Electrical as well as hydraulic drive means, for which the driving torque may be changed by measuring the pressure or the delivery volume or, respectively, by measuring the current, are known. Increasing the driving torque indicates that the supply means delivers more material than the conveying cylinder handles.

By means of the present invention the delivery volume of the material can be simply measured to adjust the supply means to a desired delivery volume. The provisions necessary are extremely simple and can be readily formed.

The foregoing and other objects, features and advantages of the invention will become apparent in the light of the following detailed description of an embodiment thereof, as illustrated in the accompanying drawings.

BRIEF DESCRIPTION OF THE DRAWINGS

The single figure shows schematically a tandem piston pump including a supply means.

DETAILED DESCRIPTION

A first and second conveying cylinder 10, 12 each is provided with conveying pistons 14, 16 each being connected through pistons rod with a piston 18,20, respectively, of hydraulic drive cylinders 22, 24. The outlets of the conveying cylinders 10, 12 communicate with valve chambers 26, 28 in which suction valves 30, 32 are provided which are operable to selectively connect the conveying cylinders 10, 12 to supply line 34 for the material to be pumped, the line 34 including a screw pump 36 driven by a hydraulic motor 38. The valve chambers 26, 28 are connected to valve chambers 40, 42 in which a pressure valve 44, 46, respectively are arranged. The individual valves are actuated by hydraulic cylinders 48, 50, 52, 54.

The valve chambers 40, 42 communicate with a common delivery line 56.

End position transmitters S7, S8 and S9, S10 are provided for the hydraulic cylinders 22, 24 for generating a signal when the pistons 18, 20 move into the end position. The end position transmitters are provided to control the valves 30, 32, 44, 46. The cylinders 10, 12, will be actuated by the hydraulic cylinders 22, 24 such that cylinder 12 performs a pumping stroke at the time when cylinder 10 performs a suction stroke and vice versa. This is effected by connecting both piston rod sided chambers of the hydraulic cylinders 22, 24 to each other.

While cylinder 10 performs a suction stroke, the suction valve 30 is open and the pressure valve 44 is closed. The hydraulic piston, 18 moves from transmitter S7 to the transmitter S8. At the same time the cylinder 12 performs a pumping stroke during which the suction valve 32 is closed and the pressure valve 44 is open. The piston 20 moves from transmitter S10 towards the transmitter S9. As soon as the end position is reached, the valves 30, 32, 44, 46 are immediately switched over whereas the supply of the material to the hydraulic cylinders 22, 24 through suitable directional valves (not shown) is time-delayed. Thereafter, the conveying cylinder 12 starts a suction stroke and the conveying cylinder 10 a pumping stroke at the same time.

Normally, the conveying cylinders 10, 12 are not fully filled with a slurry during the suction stroke, as indicated for the cylinder 12 in the drawings. Only then when the piston 16 builds up a cylinder full of slurry, as indicated at 12' after moving a stroke distance X, the oil pressure in the associated cylinder 24, 24' suddenly reaches the working pressure. This may be sensed by a pressure switch 60 generating a signal to be supplied to a processor 62. The processor 62 is connected to the transmitters S7 to S10 as well, as indicated in the drawings for the transmitters S7 and S8. The percent fill of each of the conveying cylinders 10, 12 can be determined by means of the distances through which the pistons have moved. A stroke measuring system, however, is relatively complicated. Therefore, the delivery volume is determined depending on the percent fill as follows:

When the pistons 18, 20 move out of their rearward end position, a first and second time measuring means are started in the processor 62. The first time measuring means stops as soon as a pressure peak is sensed by the oil pressure switch 60. The second time measuring means stops when the pistons 18, 20 have moved into their forward end position. The percent fill of each of the conveying cylinders 10, 12 is calculated by performing the following comparison $$\frac{S_H - S_I}{S_H} = \frac{t_H - t_I}{t_H}$$

wherein $S_H$=stroke of the piston in the cylinder $S_H$=stroke from the rearward end position to position in which the bulk is formed $t_H$=stroke time between the rearward and forward end position of the piston $t_I$=stroke time between the rearward end position and the position in which the slurry bulk in the cylinder is reached (pressure peak in the hydraulic line).

The delivery volume is calculated according to $$Q_T = \frac{V_T}{t_H - t_I}$$

wherein $Q_T$=flow volume of the cylinder not completely filled $V_T$=volume of the cylinder not completely filled. From equaling $$\frac{S_H - S_I}{S_H} = \frac{t_H - t_I}{t_H}$$

follows $$V_T = V_Z \frac{t_H - t_I}{t_H}$$

From this follows the delivery volume F $$(kg) = V_T(m^3) \cdot e(kg/m^3),$$

wherein $V_T$=volume of the medium to be pumped;

$V_2$=volume of the pump cylinder

F=delivery volume of each conveying cylinder e=density.

From this follows $$F = V_z \frac{t_H - t_I}{t_H} \cdot e$$

The delivery volumes of the conveying cylinders 10, 12 and of the supply means 36 are preferably matched with respect to each other, i.e, identical flow rates are preferred. The time $t_I$ sensed in the processor 62 is indicative of the idle stroke of the piston 14, 16. The longer this time, the lower is the percent fill. To optimize the percent fill, the time $t_I$ and thus the idle stroke of the piston 14, 16 should be as short as possible. The delivery volume of the supply means 36 is determined by the speed of the hydraulic motor 38 driven by a hydraulic pump (not shown). The speed of the motor 38 depends on adjusting a control valve 64 in the supply line to the motor 38. A central, or control device 66 which can be integrated in the processor 62 and compares the idle stroke time $^{t}I$ as mentioned before which is determined by the processor 62 or by a separate time measuring means, and a predetermined time period. More material has to be discharged from the supply means 36, when the measure time $^{t}I$ exceeds the predetermined time. Accordingly, the speed of the motor 38 is increased by controlling the control valve 64 to increase the discharge volume. The increase is continued as long until the measured time $^{t}I$ falls again below the predetermined time.

When too much slurry is supplied, the pressure correspondingly increases in the hydraulic line leading to the motor 38. There is provided a pressure sensor 68 to generate a signal to be supplied to the control device 66 in which the pressure signal is compared with a predetermined pressure value to lower the hydraulic flow volume to the motor 38 for reducing the supply volume of viscous material. Obviously, different devices may be used to indicate when the volume supplied by the supply means 36 is too high. When this occurs, the torque to be overcome by the motor 38 necessarily and suddenly increases. This can be determined by a suitable measurement. In case the motor 38 is replaced by an electro motor, the current increase thereof may be used for controlling, for example.

We claim:

1. A pump for pumping viscous material including in combination:

at least a pump cylinder having a supply line and a delivery line and having a pump piston connected to a drive piston of a hydraulic drive cylinder in order to be operated between a suction stroke for filling the viscous material into said pump cylinder and a pumping stroke for conveying the viscous material out of said pump cylinder;

end position transmitters structured and arranged to said hydraulic drive cylinder for generating a signal indicating the end position of said drive piston;

valve means communicating with said delivery outlet of said pump cylinder and controlled by the signals of said end position transmitters, which valve means operates to connect said pump cylinder to said supply line during said suction stroke and to said delivery line during said pumping stroke, respectively;

pressure switch means connected to said hydraulic drive cylinder for generating a pressure signal in case pressure increase occurs when said pump piston has left its end position at the beginning of said pumping stroke;

a time measuring means for determining the time duration of the travel of said pump piston between said end position at the beginning of said pumping stroke and said occurrence of said pressure signal;

drive means, supply means driven by said drive means for conveying the viscous material to be pumped into said supply line for delivery to said pump cylinder, with at least one of said drive means and said supply means being controllable to change the flow volume of the viscous material supplied to said pump cylinder; and comparator means for comparing said time duration of said pumping stroke until said occurrence of said pressure increase with a predetermined time interval and for generating a signal when said measured time duration exceeds a predetermined time interval, with aid signal being transmitted to at least one of said drive means and said supply means for increasing the flow volume of the viscous material to said pump cylinder.

2. The viscous material pump of claim 1 wherein said drive means is a hydraulic motor.

3. The viscous material pump of claim 1 wherein said drive means is an electro motor.

4. The viscous material pump of claim 2 wherein when a pressure sensor means measures the pressure of said drive cylinder to generate a pressure signal which exceeds a predetermined pressure value, said signal is transmitted to said supply means for decreasing the flow volume of the viscous material to said pump cylinder.

5. The viscous material pump of claim 3 further including measuring means for measuring the current of said electro motor to generate a current signal which exceeds a predetermined current value, with said signal being transmitted to said supply means for decreasing the flow volume of the viscous material to said pump cylinder.

* * * * *

UNITED STATES PATENT AND TRADEMARK OFFICE

CERTIFICATE OF CORRECTION

PATENT NO. : 5,336,052

DATED : August 9, 1994

INVENTOR(S) : Peter Jorg Zollner and Winfried Bussmann

It is certified that error appears in the above-indentified patent and that said Letters Patent is hereby corrected as shown below:

| COLUMN | LINE | |
|---|---|---|
| 4 | 19 | Delete "$s_H$ = " and insert -- $s_I$ = -- |

Signed and Sealed this

Twenty-fifth Day of October, 1994

*Attest:*

*Attesting Officer*

Bruce Lehman

BRUCE LEHMAN

*Commissioner of Patents and Trademarks*